United States Patent [19]

Cantor

[11] Patent Number: 4,974,839

[45] Date of Patent: Dec. 4, 1990

[54] MULTI-FUNCTIONAL ADJUSTABLE WEIGHT LIFTING & EXERCISE APPARATUS

[76] Inventor: Michael Cantor, 201 Forest St., Oceanside, N.Y. 11572

[21] Appl. No.: 461,226

[22] Filed: Jan. 5, 1990

[51] Int. Cl.[5] ..... A63B 21/078

[52] U.S. Cl. ..... 272/123; 272/144

[58] Field of Search ..... 272/117, 118, 123, 134, 272/144

[56] References Cited

U.S. PATENT DOCUMENTS

| | | | |
|---|---|---|---|
| 4,575,077 | 3/1986 | Osborne et al. | 272/123 X |
| 4,635,934 | 1/1987 | Roethke | 272/144 |
| 4,653,751 | 3/1987 | Green | 272/144 |
| 4,749,190 | 6/1988 | Jennings | 272/144 |
| 4,765,616 | 8/1988 | Wolff | 272/123 X |

*Primary Examiner*—Robert Bahr

*Attorney, Agent, or Firm*—Frederick Cantor

[57] ABSTRACT

A multi-functional, adjustable, weight lifting and exercise apparatus, is described. The weight lifting apparatus allows a user to configure the apparatus among a plurality of different positions, so that a full range of user support platform incline, as well as, adjustable decline positions, is also obtainable, while allowing at the same time unobstructed user access to barbell weights, which are supported on an adjustable weight support structure, located at the head end of the apparatus. The apparatus is also fully adjustble, so that barbell weights supported on the barbell weight support structure, can be readily accessed and lifted properly in numerous specific exercises. The platform decline position, allowing the performance of the decline barbell benchpress, with proper user access to the weights, supported on the weight support structure, is accomplished by the coordination of the movements of a fully adjustable, horizontally slidable, user support platform structure, a unique support platform hinge mechanism, as well as the fully adjustable and removable back height position bar.

12 Claims, 2 Drawing Sheets

MULTI-FUNCTIONAL ADJUSTABLE WEIGHT LIFTING & EXERCISE APPARATUS

BACKGROUND OF THE INVENTION

The present invention relates to adjustable weight lifting and exercise apparatus.

The present invention also relates to multi-functional adjustable weight lifting and exercise apparatus.

The present invention further relates to a multi-functional adjustable weight lifting and exercise apparatus, which also allows for the achievement of fully adjustable, discrete decline and incline, operator support platform positions.

The present invention more particularly relates to a multi-functional weight lifting and exercise apparatus, which also allows for adjustable decline and incine positions, which readily permits user access to barbell weights supported on adjustable height, weight support means.

The unique support platform decline position, obtainable with concurrent proper user access to barbell weights, supported on adjustable height weight support means, is accomplished primarily by the coordinated combination of a fully adjustable operator support platform sliding means, support platform hinge means, as well as a fully adjustable and removable back height position bar.

The prior art has shown various types of weight lifting benches, which have been commercially available for years. The basic operative features, include a bench frame supporting a platform, with two vertically oriented barbell weight supports, disposed at one end of the bench frame. At rest, the barbell weights are supported in a position above the supine body of the user. The user extends both arms vertically, grasps the barbell, and pushes the weights off the weight support rack to a full arm extension, in, what is known as a barbell bench press. By alternately lowering the barbells to the chest, and raising the weights once again to arms length, the desired number of barbell bench press repetitions, can be achieved.

The prior art devices have lacked the necessary versatility and performance modes for the serious power weight lifter, so that modifications were made, which ultimately transformed this essentially one-dimensional invention, into the multi-functional units available today. The modern prior art devices, generally include configurations to perform not only the standard bench press movements, as described above, but also a number of other specific exercises. Among those, is the means to do weight-enhanced leg extension exercises, i.e., leg curls, wherein the user sits at one end of the bench, inserts both feet under a padded weight support apparatus, attached to the foot end of the device, and alternately pivots the feet in a vertical up and down motion.

Other exercises, which the modern prior art devices have tried to accommodate, include arm contractions, i.e., arm curls, which the user accomplishes by sitting erect, or in an incline position, and by alternately extending and contracting hand-held weights, i.e., barbells or dumb bells, in repetitive downward and upward movements. A final exercise, which requires the use of the weight lifting bench, is a leg-intensive exercise, commonly known as a squat. Here, the user assumes a standing position directly behind the "head end" of the bench, in the center of upright barbell weight support racks. The user then removes the barbell weights from the weight support cradles, and rests the weights on their shoulders. The user then bends at the knees until a contracted, or "squat" position, is achieved, followed by an immediate straightening of the legs, until the user is back to a normal standing position. Following the completion of the desired number of repetitions, the user then removes the barbells from their shoulders, and places them back on the barbell weight support cradles.

Evolution of the athletic training discipline, has established that the user can obtain superior results, if additional stress was applied to the body during performance of the various weight utilizing exercises. As one means used to accomplish this, the prior art devices sought to incline the back portion of the bench, with the head elevated above the waist, so as to impose additional stress during the standard bench press work out on the upper torso and shoulder area.

Serious power weight lifters, however, have expressed a desire for a weight lifting apparatus, comprising a means whereby the back portion of the bench could be fully declined in a position towards the barbell weight support racks, with the head below the waist, so that a much more intensive variation of the standard, or inclined bench press, could be performed.

However, attempts by the prior art devices to successfully implement a means for the full decline configuration, have heretofore been unsatisfactory. In fact, due to a prior art common problem, which the present invention has solved, previous devices could not provide a means by which the bench support platform could be readily fully declined, so that the head was below the waist level, while at the same time allowing full and unobstructed access to weights, on a barbell weight support rack. The prior art devices, could only provide for limited user access to the barbell weights, when the bench portion was in the inclined configuration. The apparatus design, inherent in the prior art devices, resulted in a fixed support platform back position, oriented horizontally between the weight support rack uprights, and generally at the waist level of the user. The configuration of the prior art design, prevented a decline bench position, with the head below the waist, and further limited convenient user access to the barbell weights, when the bench was configured in the incline position.

In the present invention, however, the full decline support platform position can be achieved, without any obstruction to user access to barbell weights, so that the user can engage in any form of decline or incline bench press exercise with complete safety, by the coordination of an adjustable seat-back support platform sliding means, incorporating a unique support platform hinge means, and a fully adjustable and removable back height position bar.

The present design also allows for the discrete support platform back component, to be inclined or declined, from a zero degree horizontal longitudinal position, to a plurality of configurations, throughout the full range of incline and decline positions.

Furthermore, the discrete back and discrete seat components of the operator support platform, are hinged to a single common hinge means, and yet may be pivoted fully independently of each other. This design capability, permits the user, for example, to configure the discrete back-seat components, so that bent-hip leg curl extensions can be performed, a capability not found in the prior art devices.

The present invention also embodies a superior design, which facilitates proper form for barbell-employed squat exercises. In the prior art devices, the fixed back support designs, discussed above, also presented a stationary obstacle to the proper execution of barbell squats, which often resulted in injury to the exposed shin area of the user.

The present invention solves this problem with a unique design, allowing for the rapid and convenient removal and insertion of the adjustable back height position bar. When the back height position bar is fully removed, the user can now also "walk through" the region enclosed by the barbell weight support means, to a position directly beneath the supported barbell weights. This position allows the user to perform squat exercises with the proper form, thereby reducing or eliminating the risk of user back or shin injury.

In comparison with the limited design capabilities of the prior art devices, the innovative features of the present invention, clearly show a weight lifting and exercise device, that is fully adjustable, throughout its entire range of weight-utilizing, exercise configurations.

SUMMARY OF THE INVENTION

It is, therefore, an object of the present invention, to provide an adjustable weight lifting and exercise apparatus.

It is another object of the present invention, to provide a multi-functional adjustable weight lifting and exercise apparatus.

It is yet another object of the present invention, to provide a multi-functional adjustable weight lifting and exercise apparatus, which also allows for the achievement of fully adjustable discrete decline and incline operator support platform seat-back positions.

It is still yet another object of the present invention, to provide a multi-functional weight lifting and exercise apparatus, which allows for adjustable decline and incline positions, which readily permit user access to barbell weights supported on adjustable height weight support means.

It is an additional object of the present invention, to allow the user to perform standing barbell squat leg contractions, with proper form and unobstructed access to barbells in their weight support cradles. This is accomplished by easy full removal of the back height position bar, thereby allowing the user to "walk through" the region enclosed by the weight support uprights, to a proper and safe position, directly beneath the supported barbells.

It is a further object of the present invention, to allow the user to perform bent hip leg curls. This is accomplished by adjusting the discrete support platform seat component, allowing a leg-lowered position, with the user sitting upright on the horizontal discrete back portion, placing their knees over the discrete seat portion, and performing the desired repetitions of leg curls.

The unique back decline position, with the head below the waist, is obtainable with concurrent proper user access to barbell weights, supported on the adjustable weight support means. This is accomplished primarily by the coordinated combination of a fully adjustable and slidable operator support platform means, an operator support platform seat-back hinge means, as well as a fully adjustable and removable back height position bar.

The present invention overcomes the aforementioned limitations of the prior art devices, by providing a unique multi-functional adjustable weight lifting and exercise apparatus. Its multi-functional design features, allow the user to configure the operative elements thereof, so that the above-described exercises, can be properly executed in a convenient and safe manner.

Specifically, the present invention incorporates adjustable operator support platform seat-back positioning, to permit high stress power weight lifting exercises, whereby the available configurations, provides the user convenient access to barbell weights, located on the adjustable weight support means.

The above, and other objects of the present inveniton, are accomplished in accordance with the herein described exemplary preferred embodiments of the present invention.

1. A multi-functional, adjustable, weight lifting and exercise apparatus, comprised of:

(a) an apparatus base means;

(b) a slidable, user support platform means, having discrete seat and back components;

(c) said support platform means, being slidably mounted along said base means;

(d) an adjustable support platform hinge means;

(e) said hinge means, being mounted to said support platform means;

(f) said hinge means being fully adjustable, so that said support platform means, may be configured into desired, discrete, partial or full, decline and incline seat and back positions;

(g) an adjustable weight support means, onto which weights are removably placed;

(h) said weight support means, being attached to said apparatus base means;

(i) a back height position means;

(j) said back height position means, being removably mounted onto said weight support means; and (k) said weights, resting on said weight support means, and being fully accessible to said user, either standing, or situated on said support platform means, with said seat and back, decline and incline positions, being in desired configurations.

2. A multi-functional adjustable weight lifting and exercise apparatus, comprised of:

(a) a substantially elongated, horizontally oriented, apparatus base means;

(b) a user support platform means, being slidably mounted onto, and longitudinally slidable, along said base means;

(c) said support platform means, further comprising a discrete back portion and a discrete seat portion, as well as a support platform sliding means;

(d) a support platform hinge means, with said hinge means, being mounted to said support platform means;

(e) said hinge means, being pivotally adjustable, so that said seat and back portions, may be individually and variably adjusted, to desired incline and decline positions;

(f) a vertically-oriented, adjustable, weight support means, said weight support means, being attached to said base means;

(g) said weight support means, further comprising a plurality of weight support uprights;

(h) said weight support uprights, further being vertically adjustable, and incorporating barbell weight support cradles, onto which weights are placed and removed;

(i) a back height position means, said back height position means, being attachable to, or fully removable from, said weight support means, at varied heights; and (j) said back height position means, being positionable, or fully removable, allowing for a plurality of user-selectable back portion decline and incline configurations.

(k) said weights, resting on said weight support means, and being fully accessible to said user, either standing, or situated on said support platform means, with said seat and back, decline and incline positions, being in desired configurations.

3. The multi-functional weight lifting and exercise apparatus, as described in paragraph 1 above, wherein said fully adjustable, and removable, back height position means, further comprises an elongated back height position bar, with position bar having locating sleeves, mounted to ends of said position bar, and, whereby, said position bar, may be positioned horizontally on said weight support means, by placing said locating sleeves over position bar cradles, located on said weight support means.

4. The multi-functional weight lifting and exercise apparatus, as described in paragraph 2 above, wherein said fully adjustable, and removable, back height position means, further comprises an elongated back height position bar, with position bar having locating sleeves, mounted to ends of said position bar, and, whereby, said position bar, may be positioned horizontally on said weight support means, by placing said locating sleeves over position bar cradles, located on said weight support means.

5. The multi-functional weight lifting and exercise apparatus, as described in paragraph 1 above, wherein said base means, further comprises a sliding track means, a sliding track attachment plate, and a base elevation means, wherein said support platform means, further comprises a sliding clamp means, said clamp means, slidably surrounding said sliding track means, wherein said support platform means, is thereby slidably attached to said sliding track means.

6. The multi-functional weight lifting and exercise apparatus, as described in paragraph 2 above, wherein said base means, further comprises a sliding track means, a sliding track attachment plate, and a base elevation means, wherein said support platform means, further comprises a sliding clamp means, said clamp means, slidably surrounding said sliding track means, wherein said support platform means, is thereby slidably attached to said sliding track means.

7. The multi-functional weight lifting apparatus, as described in paragraph 1 above, wherein said user support platform means, further comprises both a discrete seat portion, and a discrete back portion, said discrete portions being attached to said hinge means, with said hinge means being further attached to said user support platform means.

8. The multi-functional weight lifting apparatus, as described in paragraph 2 above, wherein said user support platform means, further comprises both a discrete seat portion, and a discrete back portion, said discrete portions being attached to said hinge means, with said hinge means being further attached to said user support platform means.

9. The multi-functional weight lifting and exercise apparatus, as described in paragraph 1 above, wherein, after removal, or adjustment of said back height position bar, a user can pivotally adjust said back portion into a plurality of incline and decline positions, and wherein said seat portion, can further be pivotally adjusted into a plurality of incline configurations.

10. The multi-functional weight lifting and exercise apparatus, as described in paragraph 2 above, wherein, after removal, or adjustment of said back height position bar, a user can pivotally adjust said back portion into a plurality of incline and decline positions, and wherein said seat portion, can further be pivotally adjusted into a plurality of incline configurations.

DETAILED DESCRIPTION OF THE PREFERRED EMBODIMENT OF THE PRESENT INVENTION

With reference now to the accompanying drawings, the multi-functional adjustable weight lifting and exercise apparatus, will now be described in greater detail.

Figure 1:
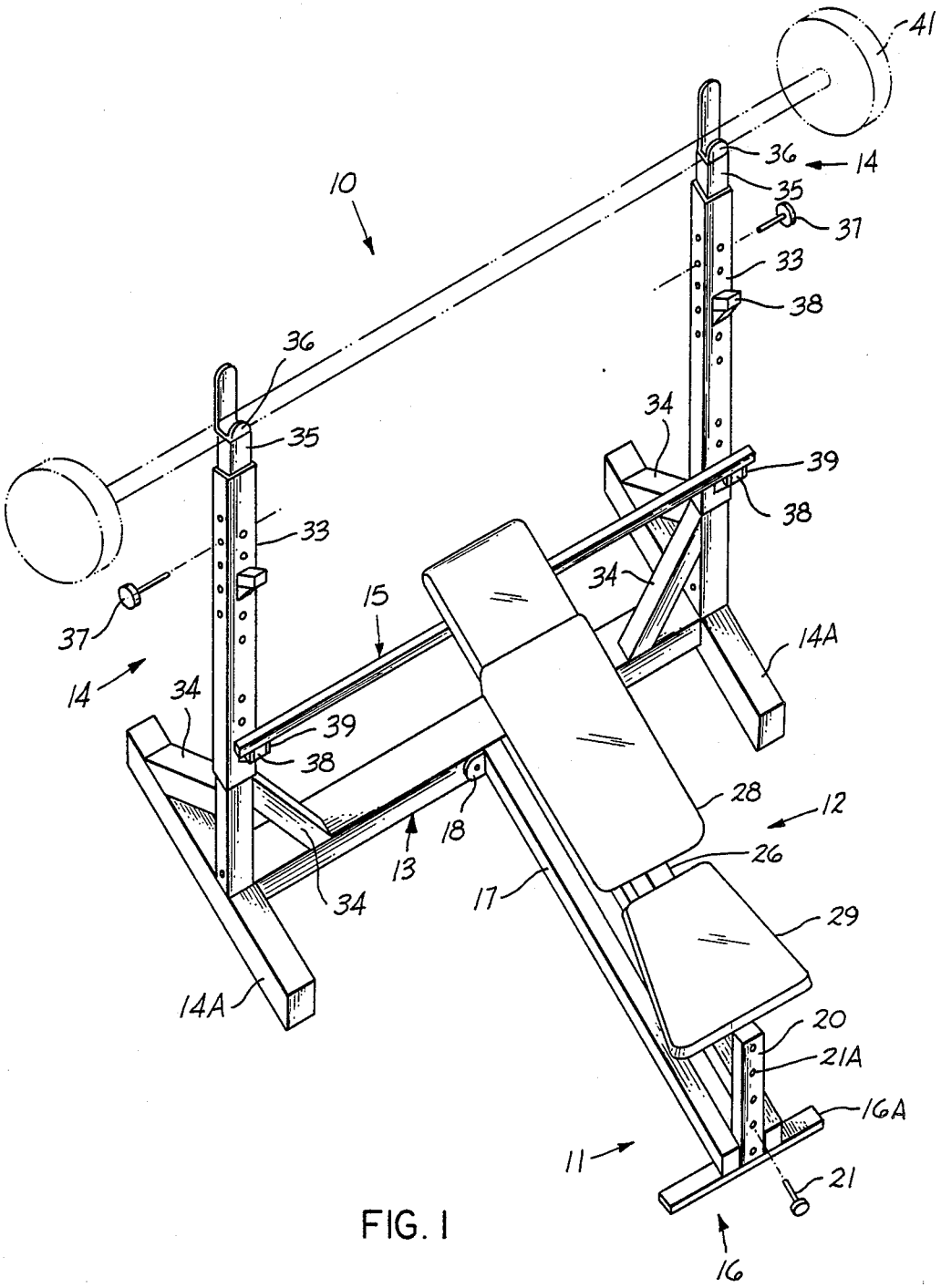
FIG. 1, is a general perspective view, of the weight lifting and exercise apparatus of the present invention.

Referring now to FIG. 1, which is a general perspective view, of the weight lifting and exercise apparatus, as configured, according to the present invention.

The weight lifting and exercise apparatus, is shown generally as 10, and includes the apparatus base means 11, onto which is slidably mounted the support platform means 12. The weight lifting apparatus 10, further comprises, a weight support beam 13, a pair of upright, vertically oriented, adjustable height, barbell weight support uprights 14, as well as the fully removable, back height position bar 15, which is shown here in the mounted position. The apparatus base means 11, which further comprises a sliding track means 17, and an elevation means 16, located at the "foot end" of the apparatus 10.

Figure 3:
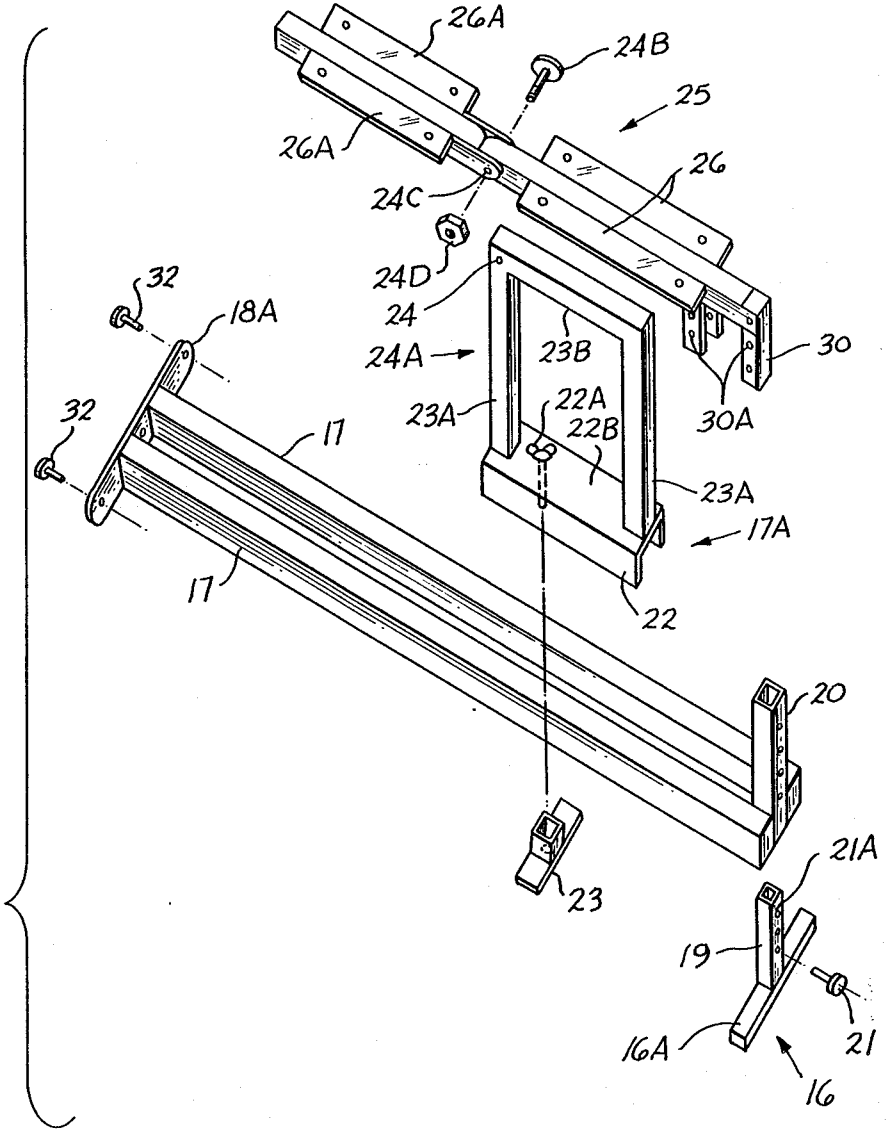
FIG. 3, is a fragmentary perspective view, fully exploded, of the user support platform means, including support platform hinge means and apparatus base means of the present invention.

Referring now to FIG. 3, which is a perspective view, fully exploded, of the user support platform means, including the support platform hinge means, and apparatus base means, of the present invention.

The support platform means 12, slides along the sliding track means 17, (here dual tracks), which, through a sliding track attachment plate 18, is attached at the head end, to the center of the weight support beam 13, and at the foot end, rests on the apparatus elevation means base 16A. Mounted onto the elevation base 16A, is an upright, apparatus elevation post 19. Additionally, a hollow, telescoping apparatus elevation bar 20, which is situated between the foot end of the dual tracks of the sliding track means 17, adjustably receives the elevation post 19. The elevation of the "foot end" of the apparatus, is secured at the desired height, by means of raising the foot end of the sliding track means 17, and the insertion of an elevation locking pin 21, into corresponding locking pin alignment holes 21A, found on the elevation post 19, as well as the elevation bar 20.

Slidably mounted onto the sliding track means 17, is the support platform sliding means 17A, of the support platform means 12. The platform sliding means 17A, may be readily positionable along the sliding track means 17, by means of a platform sliding clamp 22. The sliding clamp 22, is fixed into position by tightening a sliding clamp positioning screw 22A, located in a receptacle on the top surface 22B, of the sliding clamp 22, and screw 22A, is also screwed into the sliding clamp friction plate 23.

Attached to the top surface 22B, of the sliding clamp 22, is the seat attachment frame 24A, which is comprised of a pair of attachment frame posts 23A, vertically, and perpendicularly oriented to the sliding track means 17, as well as a horizontally oriented, attachment frame member 23B, incorporating a hinge pin receptacle 24.

The unique support platform hinge means, shown generally as 25, consists of pairs of flat, right-angled, horizontally oriented, back hinge members 26A, and seat hinge members 26, which are connected through a single, centrally positioned, central hinge pin receptacle 24C. The centrally positioned hinge portion is pivoted around the hinge pin receptacle 24, and fixed by means of a single support platform hinge pin 24B, and locking nut 24D. The support platform hinge means 25, further comprises, at its "foot end" region, an optional weight device mount 30, to which may be attached various optional leg extension, sit-up, or other exercise-facilitating devices (not shown), through device mounting receptacles 30A.

Mounted to, and respectively supported by, the seat hinge members 26, and back hinge members 26A, are the discrete seat support 29, and discrete back support 28, which are not shown in this Figure. In its entirety, the slidable support platform means 12, is fully slidable along the length of the sliding track means 17, while at the same time allowing the user to both pivot and set, the discrete back support 28, and seat support 29, portions, into a number of multi-angular or coplanar positions, as shall be further discussed below.

Figure 2:
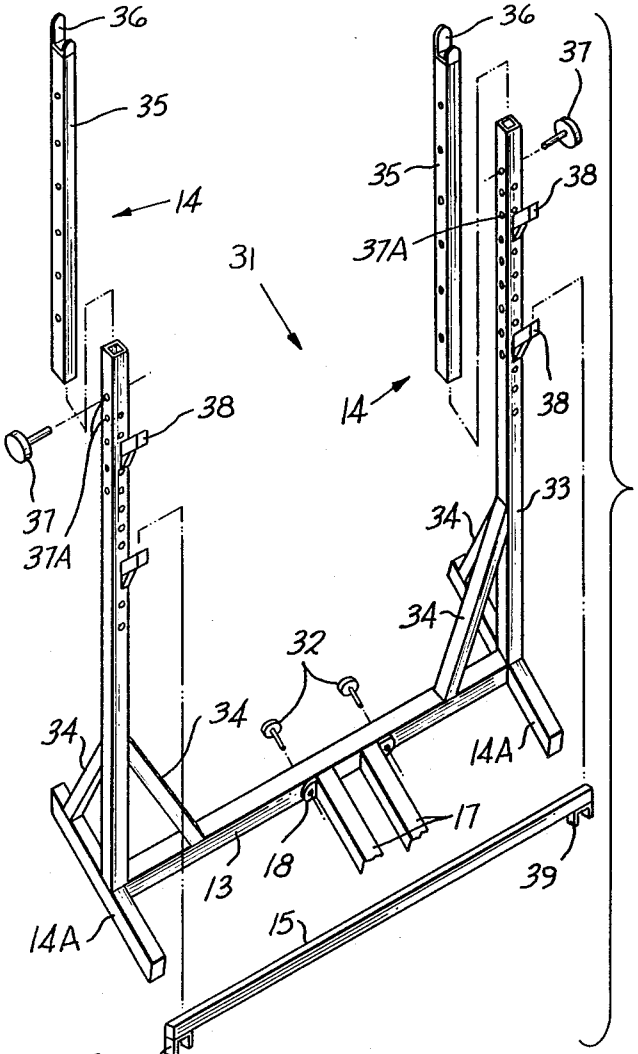
FIG. 2, is a perspective view, partially exploded, of the weight support means of the present invention.

Referring now to FIG. 2, which is a perspective view, partially exploded, of the weight support means, of the present invention. The weight support means, is shown generally as 31, and comprises the weight support beam 13, to the mid-section of which, is attached the sliding track means 17, via the attachment plate 18, by means of a pair of weight support beam screws 32.

Mounted onto the respective ends of the weight support beam 13, is a pair of vertically oriented, height adjustable, weight support uprights 14.

The weight support uprights 14, are comprised of a lower pair of hollow, vertically oriented, weight support posts 33, which are supported at their base portions, by upright bases 14A, and strengthened by a pair of short, inclined-angle weight support upright braces 34. The weight support uprights 14, further comprise an upper pair of vertically-oriented, adjustable, weight support telescoping posts 35. The telescoping posts 35, further incorporate at their top-most portions, a pair of corresponding barbell weight support cradles 36. The telescoping posts 35, fit slidably within the hollow upright weight support posts 33, and may be fixed at preselected heights, by means of the insertion of a pair of weight support upright locking pins 37, into a plurality of incorporated, vertical height alignment, weight support upright locking pin receptacles 37A, found in the support posts 33, and telescoping posts 35.

The weight support posts 33, further incorporate along their length, a plurality of back height position bar cradles 38, here shown as two cradles on each post 33. These position bar cradles 38, provide for convenient horizontal placement, and rapid removal, of the back height position bar 15. The back height position bar 15, is preset by the user, by the incorporation of a pair of back height position bar locating sleeves 39, attached to ends of the position bar 15, with which to removably mount the back height position bar 15, to the back height position bar cradles 38. Incline and decline positions of the back support 28, are manually set, by moving, and then either resting the back support 28 on the installed back height position bar 15, or the use of the support platform hinge pin 24B and locking nut 24D, for intermediate back support 28, and seat support 29, positions.

We refer again to FIG. 2, which shows the back height position adjustment bar 15, fully removed, for performance of unobstructed standing barbell exercises. In this configuration, with the support platform means 12, slid toward the "foot end" of the apparatus, the apparatus user, in a proper "walk-through" position, will be located between the weight support uprights 14, and directly underneath the barbell weights 41, shown in FIG. 1, in their position supported on the barbell weight support cradles 36. Without obstruction from the fully removable back height position bar 15, the apparatus user, in a standing position, can now conveniently access the barbell weights, in order to safely and properly carry out barbell squats and other specific exercises.

As previously explained in greater detail, the slidable operator support platform means 12, can be readily adjustably positioned to a plurality of desired points along the sliding track means 17, using the described setting means, or other conventional modes, so that certain barbell press exercises, may be readily carried out utilizing weights on the weight support uprights 14. Alternatively, the support platform means 12, can be moved, so that various other leg extension and sit-up exercises, may be readily performed.

Within this context, the discrete back support 28, can also be pivoted throughout a wide range of incline and decline positions, including full declination, with the back height position bar 15 removed, or zero-degree horizontal, as well as a full range of incline angles, to a 90 degree full vertical position. The discrete seat support 29, can also be configured within a range of positions, from zero-degree horizontal up to a 90 degree angle of inclination, by releasing, and then tightening locking nut 24D.

Co-planar back-seat support positions can also be achieved, due to the unique support platform hinge means 25, and the discrete pivoting capacity of the apparatus. With the back support 28, in a decline, or, head below the user's waist configuration, and the seat support 29, at an incline position, the user can perform full decline bench presses, or the user can configure the back support 28, and seat support 29, portions to a zero-degree coplanar configuration, so that a standard bench press configuration is readily achieved.

The apparatus components, may be constructed of steel, aluminum, or other suitable material, and both the back support 28, as well as the seat support 29 portions, can be constructed of any suitable padding materials.

Although the present invention has been described with reference to the preferred embodiments, persons skilled in the art will clearly recognize that certain equivalent changes or substitutions, may be made in both form and detail, without departing from both the spirit and scope of the present invention.

What is claimed is:

1. A multi-functional, adjustable, weight lifting and exercise apparatus, comprised of:
(a) an apparatus base means;
(b) a slidable, user support platform means, having discrete seat and back components;
(c) said support platform means, being slidably mounted along said base means;
(d) an adjustable support platform hinge means;
(e) said hinge means, being mounted to said support platform means;
(f) said hinge means being fully adjustable, so that said support platform means, may be configured into desired, discrete, partial or full, decline and incline, seat and back positions;
(g) an adjustable weight support means, onto which weights are removably placed;
(h) said weight support means, being attached to said apparatus base means;
(i) a back height position means;
(j) said back height position means, being removably mounted onto said weight support means; and
(k) said weights, resting on said weight support means, and being fully accessible to said user, either standing, or situated on said support platform means, with said seat and back, decline and incline positions, being in desired configurations.

2. A multi-functional adjustable weight lifting and exercise apparatus, comprised of:
(a) a substantially elongated, horizontally oriented, apparatus base means;
(b) a user support platform means, being slidably mounted onto, and longitudinally slidable, along said base means;
(c) said support platform means, further comprising a discrete back portion and a discrete seat portion, as well as a support platform sliding means;
(d) a support platform hinge means, with said hinge means, being mounted to said support platform means;
(e) said hinge means, being pivotally adjustable, so that said seat and back portions, may be individually and variably adjusted, to desired incline and decline positions;
(f) a vertically-oriented, adjustable, weight support means, said weight support means, being attached to said base means;
(g) said weight support means, further comprising a plurality of weight support uprights;
(h) said weight support uprights, further being vertically adjustable, and incorporating barbell weight support cradles, onto which weights are placed and removed;
(i) a back height position means, said back height position means, being attachable to, or fully removable from, said weight support means, at varied heights; and
(j) said back height position means, being positionable, or fully removable, allowing for a plurality of user-selectable back portion decline and incline configurations.
(k) said weights, resting on said weight support means, and being fully accessible to said user, either standing, or situated on said support platform means, with said seat and back, decline and incline positions, being in desired configurations.

3. A multi-functional, adjustable, weight lifting and exercise apparatus, which is integrated, allowing performance of flat, incline, decline and military barbell presses, walk-through squats, standing calf raises, leg extensions, hamstring leg curls, sit ups, parallel bar dips, and other exercises, comprised of:
(a) an apparatus base means;
(b) a slidable, user support platform means, having discrete seat and back components;
(c) said support platform means, being slidably mounted along said base means;
(d) an adjustable support platform hinge means;
(e) said hinge means, being mounted to said support platform means;
(f) said hinge means being fully adjustable, so that said support platform means, may be configured into desired, discrete, partial or full, decline or incline, seat and back positions;
(g) an adjustable weight support means, onto which weights are removably placed;
(h) said weight support means, being attached to said apparatus base means;
(i) a back height position means;
(j) said back height position means, being removably mounted onto said weight support means; and
(k) said weights, resting on said weight support means, and being fully accessible to said user, either standing, or situated on said support platform means, with said seat and back, decline and incline positions, being in desired configurations.

4. The multi-functional weight lifting and exercise apparatus, as described in claim 3, wherein said fully adjustable, and removable, back height position means, further comprises an elongated back height position bar, with position bar having locating sleeves, mounted to ends of said position bar, and, whereby, said position bar, may be positioned horizontally on said weight support means, by placing said locating sleeves over position bar cradles, located on said weight support means.

5. The multi-functional weight lifting and exercise apparatus, as described in claim 3, wherein said base means, further comprises a sliding track means, a sliding track attachment plate, and a base elevation means, wherein said support platform means, further comprises a sliding clamp means, said clamp means, slidably surrounding said sliding track means, wherein said support platform means, is thereby slidably attached to said sliding track means.

6. The multi-functional weight lifting apparatus, as described in claim 3, wherein said user support platform means, further comprises both a discrete seat portion, and a discrete back portion, said discrete portions being attached to said hinge means, with said hinge means being further attached to said user support platform means.

7. The multi-functional weight lifting and exercise apparatus, as described in claim 3, wherein, after removal, or adjustment of said back height position bar, a user can pivotally adjust said back portion into a plurality of incline or decline positions, and wherein said seat portion, can further be pivotally adjusted into a plurality of incline configurations.

8. A multi-functional, adjustable, weight lifting and exercise apparatus, which is integrated, allowing performance of flat, incline, decline and military barbell presses, walk-through squats, standing calf raises, leg extensions, hamstring leg curls, sit ups, parallel bar dips, and other exercises, comprised of:
(a) a substantially elongated, horizontally oriented, apparatus base means;

(b) a user support platform means, being slidably mounted onto, and longitudinally slidable, along said base means;

(c) said support platform means, further comprising a discrete back portion and a discrete seat portion, as well as a support platform sliding means;

(d) a support platform hinge means, with said hinge means, being mounted to said support platform means;

(e) said hinge means, being pivotally adjustable, so that said seat and back portions, may be individually and variably adjusted, to desired incline and decline positions;

(f) a vertically-oriented, adjustable, weight support means, said weight support means, being attached to said base means;

(g) said weight support means, further comprising a plurality of weight support uprights;

(h) said weight support uprights, further being vertically adjustable, and incorporating barbell weight support cradles, onto which weights are placed and removed;

(i) a back height position means, said back height position means, being attachable to, or fully removable from, said weight support means, at varied heights;

(j) said back height position means, being positionable, or fully removable, allowing for a plurality of user-selectable back portion decline and incline configurations; and (k) said weights, resting on said weight support means, and being fully accessible to said user, either standing, or situated on said support platform means, with said seat and back, decline and incline positions, being in desired configurations.

9. The multi-functional weight lifting and exercise apparatus, as described in claim 8, wherein said fully adjustable, and removable, back height position means, further comprises an elongated back height position bar, with position bar having locating sleeves, mounted to ends of said position bar, and, whereby, said position bar, may be positioned horizontally on said weight support means, by placing said locating sleeves over position bar cradles, located on said weight support means.

10. The multi-functional weight lifting and exercise apparatus, as described in claim 8, wherein said base means, further comprises a sliding track means, a sliding track attachment plate, and a base elevation means, wherein said support platform means, further comprises a sliding clamp means, said clamp means, slidably surrounding said sliding track means, wherein said support platform means, is thereby slidably attached to said sliding track means.

11. The multi-functional weight lifting apparatus, as described in claim 8, wherein said user support platform means, further comprises both a discrete seat portion, and a discrete back portion, said discrete portions being attached to said hinge means, with said hinge means being further attached to said user support platform means.

12. The multi-functional weight lifting and exercise apparatus, as described in claim 8, wherein, after removal, or adjustment of said back height position bar, a user can pivotally adjust said back portion into a plurality of incline and decline positions, and wherein said seat portion, can further be pivotally adjusted into a plurality of incline configurations.

* * * * *